US008139976B2

(12) United States Patent
Ito et al.

(10) Patent No.: US 8,139,976 B2
(45) Date of Patent: Mar. 20, 2012

(54) DEVELOPING APPARATUS, PROCESS CARTRIDGE, AND IMAGE FORMING APPARATUS

(75) Inventors: Isao Ito, Saitama (JP); Kazuhiro Saito, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 709 days.

(21) Appl. No.: 12/256,925

(22) Filed: Oct. 23, 2008

(65) Prior Publication Data

US 2009/0154952 A1 Jun. 18, 2009

(30) Foreign Application Priority Data

Dec. 14, 2007 (JP) ..... 2007-323472

(51) Int. Cl.
*G03G 15/08* (2006.01)

(52) U.S. Cl. ..... 399/103

(58) Field of Classification Search ..... 399/103–106, 399/119

See application file for complete search history.

(56) References Cited

U.S. PATENT DOCUMENTS 5,839,028 A * 11/1998 Nomura et al. ..... 399/109

FOREIGN PATENT DOCUMENTS

| | | |
|---|---|---|
| JP | 1-152110 U | 9/1991 |
| JP | 2002-372862 | 12/2002 |
| JP | 2003-005517 | 1/2003 |
| JP | 2006-139073 | 6/2006 |

* cited by examiner

*Primary Examiner* — David Gray
*Assistant Examiner* — Gregory H Curran
(74) *Attorney, Agent, or Firm* — Morgan, Lewis & Bockius LLP

(57) ABSTRACT

A developing apparatus comprises: a housing having an opening that opens towards an image carrier on which an electrostatic latent image is formed, and a developer storing unit in which a developer is stored; a developer carrier that carries the developer stored in the developer storing unit and transports the developer to a developing region in opposition to the image carrier; a partitioning frame arranged in a groove formed between the developer carrier and the developer storing unit of the housing, that is provided with a connecting hole which enables connect between the developer storing unit and the opening; a partition arranged on a side surface of the partitioning frame; and a closely contact section that causes the partitioning frame to closely contact to the groove.

12 Claims, 7 Drawing Sheets

DEVELOPING APPARATUS, PROCESS CARTRIDGE, AND IMAGE FORMING APPARATUS

CROSS-REFERENCE TO RELATED APPLICATIONS

This application is based on and claims priority under 35 U.S.C. 119 from Japanese Patent Application No. 2007-323472, which is filed on Dec. 24, 2007.

BACKGROUND

1. Technical Field

The present invention relates to developing apparatuses used in image forming apparatuses such as electrophotographic copying machines and printers in which a latent image on an image carrier is made visible, and to process cartridges and image forming apparatuses.

2. Related Art

In recent years a large number of models of recording apparatuses in which an electrophotographic principle is applied have been available in the market using a cartridge (a so-called process cartridge) aiming to improve operability and also to integrate into a single entity the members that execute the electrophotographic processes.

Furthermore, there is also a demand for recording apparatuses to be more compact such that greater compactness is desired also for the structural elements constituting the process cartridge. One of these structural elements is the developing apparatus. In the developing apparatus, a developer accommodating unit is formed in which developer is filled in advance, and the developer inside the developer accommodating unit is transported to a developer carrier via an opening.

On the other hand, there are technologies for sealing the opening using a seal member so as to prevent the developer inside the developer accommodating unit from leaking outside when transporting an unused process cartridge. The seal member is peeled off by a user at the commencement of usage.

SUMMARY

In an aspect of the present invention, there is provided a developing apparatus, comprising: a housing having an opening that opens towards an image carrier on which an electrostatic latent image is formed, and a developer storing unit in which a developer is stored; a developer carrier that carries the developer stored in the developer storing unit and transports the developer to a developing region in opposition to the image carrier; a partitioning frame arranged in a groove formed between the developer carrier and the developer storing unit of the housing, that is provided with a connecting hole which enables connect between the developer storing unit and the opening; a partition arranged on a side surface of the partitioning frame; and a closely contact section that causes the partitioning frame to closely contact to the groove.

BRIEF DESCRIPTION OF THE DRAWINGS

An exemplary embodiment of the present invention will be described in detail based on the following figures, wherein.

DETAILED DESCRIPTION

An exemplary embodiment of the present invention is described with reference to the accompanying drawings.

Configuration

Overall Configuration of Image Forming Apparatus

Figure 1:
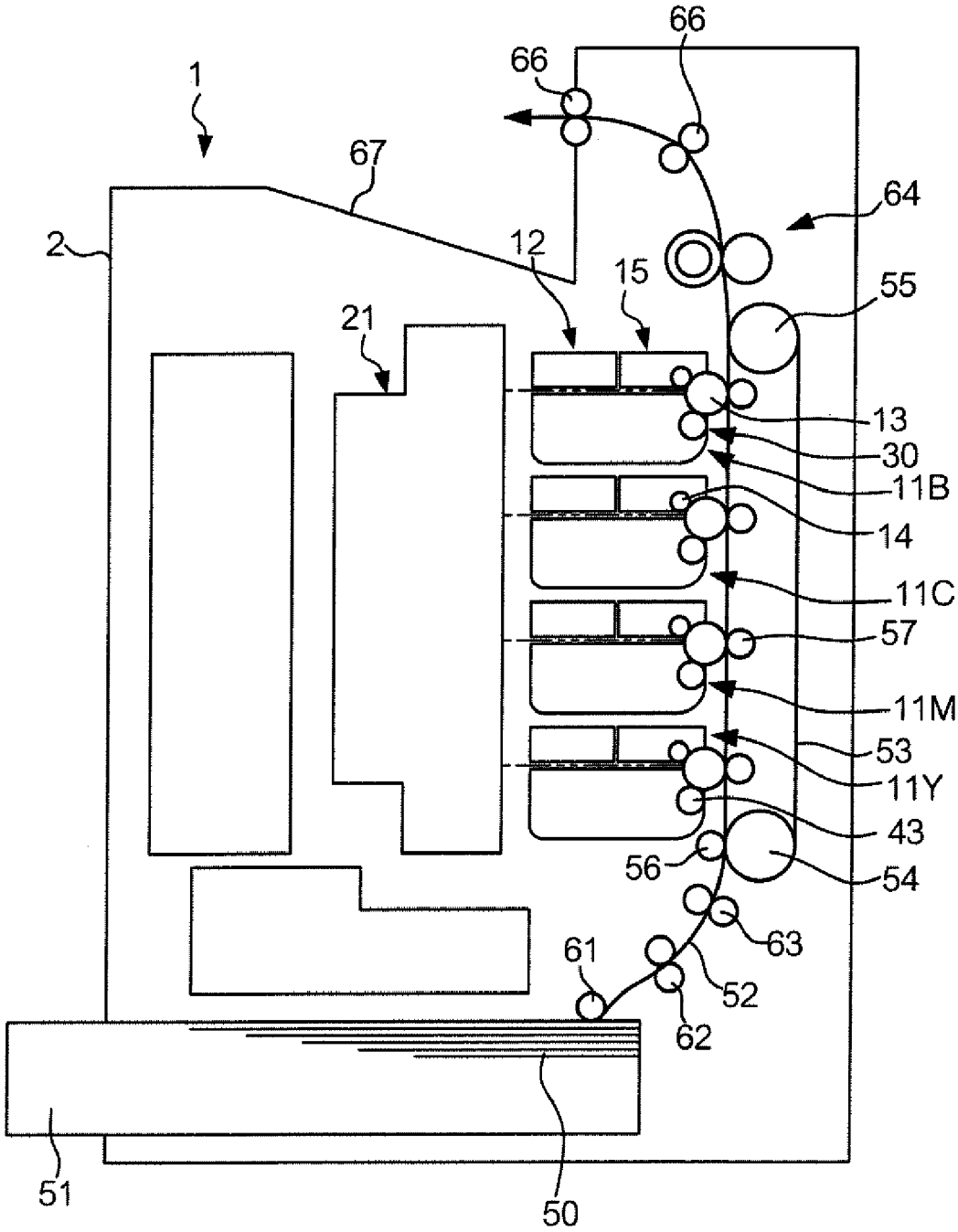
FIG. 1 is an overall configuration diagram showing an image forming apparatus according to an exemplary embodiment of the present invention.

FIG. 1 is a diagram showing an overall configuration of an image forming apparatus in which developing apparatuses according to an aspect of the invention are installed.

An image forming apparatus 1 according to the present exemplary embodiment is a so-called tandem-type color image forming apparatus in which image forming units 11 (specifically 11Y, 11M, 11C, and 11B) of four colors (in the present exemplary embodiment these are yellow, magenta, cyan, and black) are arranged in a vertical direction inside an apparatus casing 2, and provided thereunder is a paper supply cassette 51, in which papers 50 are accommodated for supply, and a paper transport path 52, which is a transport path for the papers 50 from the paper supply cassette 51, is arranged in a vertical direction along locations corresponding to each of the image forming units 11.

The image forming units 11 form toner images for yellow, magenta, cyan, and black in order from the upstream side of the paper transport path 52 and are provided with process cartridges 12, in which various process units are incorporated, and an exposure device 21 that irradiates a scanning light for image forming onto each of the process cartridges 12.

Each of the process cartridges 12 is in a form of an integrated cartridge including a photosensitive drum 13, a changing roller 14 that charges the photosensitive drum 13 in advance, a developing apparatus 30 that develops, with a corresponding color toner (in the present exemplary embodiment having a negative polarity for example), an electrostatic latent image that has been exposed and formed by the exposure device 21 on the photosensitive drum 13 that has been charged, and a cleaning device 15 that removes waste toner on the photosensitive drum 13.

The exposure device 21 houses inside a case a semiconductor laser, a polygon mirror, an imaging lens, and a mirror, which are not shown in the diagram, and uses the polygon mirror to deflect and scan the light from the semiconductor laser such that a light image is guided to exposure points on the photosensitive drum 13 via the imaging lens and the mirror.

Further still, a transport belt 53 is arranged so as to rotate and move along the paper transport path 52 in locations corresponding to the photosensitive drums 13 of the image forming units 11. The transport belt 53 is constructed using a belt material (rubber or resin) that is capable of achieving electrostatic adsorption of the papers 50 and is arranged spanning a pair of tensioning rollers 54 and 55.

A paper adsorption roller 56 is arranged at an entrance site (a site opposing the tensioning roller 54) of the transport belt 53, and the paper 50 is adsorbed to the transport belt 53 by applying a high-voltage adsorption voltage to the paper adsorption roller 56. Furthermore, transfer rollers 57 are arranged respectively on a rear surface side of the transport belt 53 corresponding to the photosensitive drum 13 of each of the image forming units 11, and the photosensitive drum 13 and the paper 50 on the transport belt 53 are caused to contact each other by the transfer roller 57. And a predetermined transfer bias is applied as appropriate by a transfer bias power source between the transfer rollers 57 and the photosensitive drums 13.

Furthermore, a pickup roller 61 that takes out the papers 50 with a predetermined timing is arranged near the paper supply cassette 51, and this feeds in the papers 50 to transfer positions via transport rollers 62 and registration rollers 63.

A fixing device 64 is provided on the paper transport path 52 positioned on a downstream side of the image forming unit 11B, which is positioned the farthest downstream, and multiple discharge rollers 66 for discharging the papers are provided on the downstream side of the fixing device 64, and discharged papers are collected in a collecting tray 67, which is formed on an upper area of the apparatus casing 2.

In the thus-configured image forming apparatus, image forming is carried out by the following processes.

In each of the image forming units 11 (11Y, 11M, 11C, and 11B), the photosensitive drum 13 is charged by the charging roller 14, and after a latent image has been formed on the photosensitive drum 13 by the exposure device 21, a visible image (toner image) is formed by the developing apparatus 30.

Meanwhile, the paper 50 from the paper supply cassette 51 is drawn out by the pickup roller 61 with a predetermined timing, then fed into an adsorption position of the transport belt 53 via the transport rollers 62 and the registration rollers 63, then fed into the transfer positions while adsorbed to the transport belt 53.

The toner images on the photosensitive drum 13 of each of the image forming units 11 are successively transferred to the paper 50 by the transfer rollers 57, then after the unfixed toner images of each of the color components on the paper 50 are fixed by the fixing device 64, the now-fixed paper 50 is discharged to the collecting tray 67.

Overview of Process Cartridge

Each of the process cartridges 12 is equipped with components such as the photosensitive drum 13, the charging roller 14, the developing apparatus 30, and the cleaning device 15.

Overview of Developing Apparatus

Figure 2:
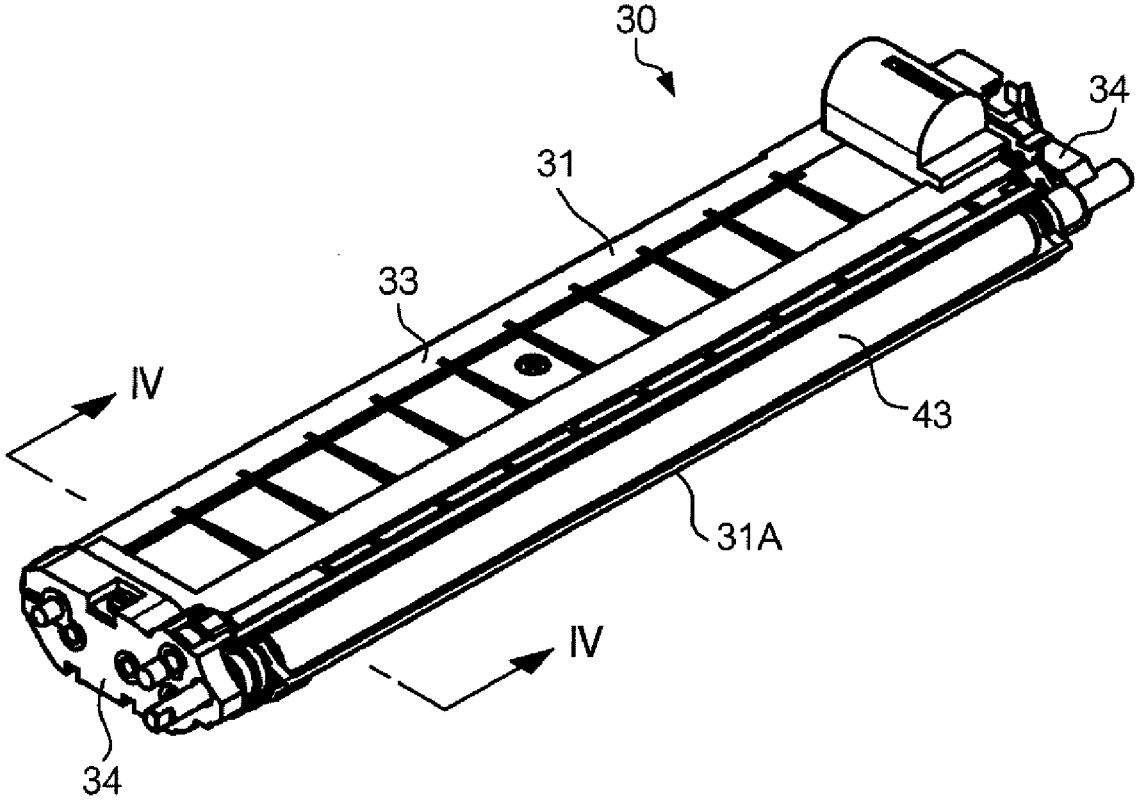
FIG. 2 is a perspective view showing a developing apparatus according to an exemplary embodiment.
Figure 3:
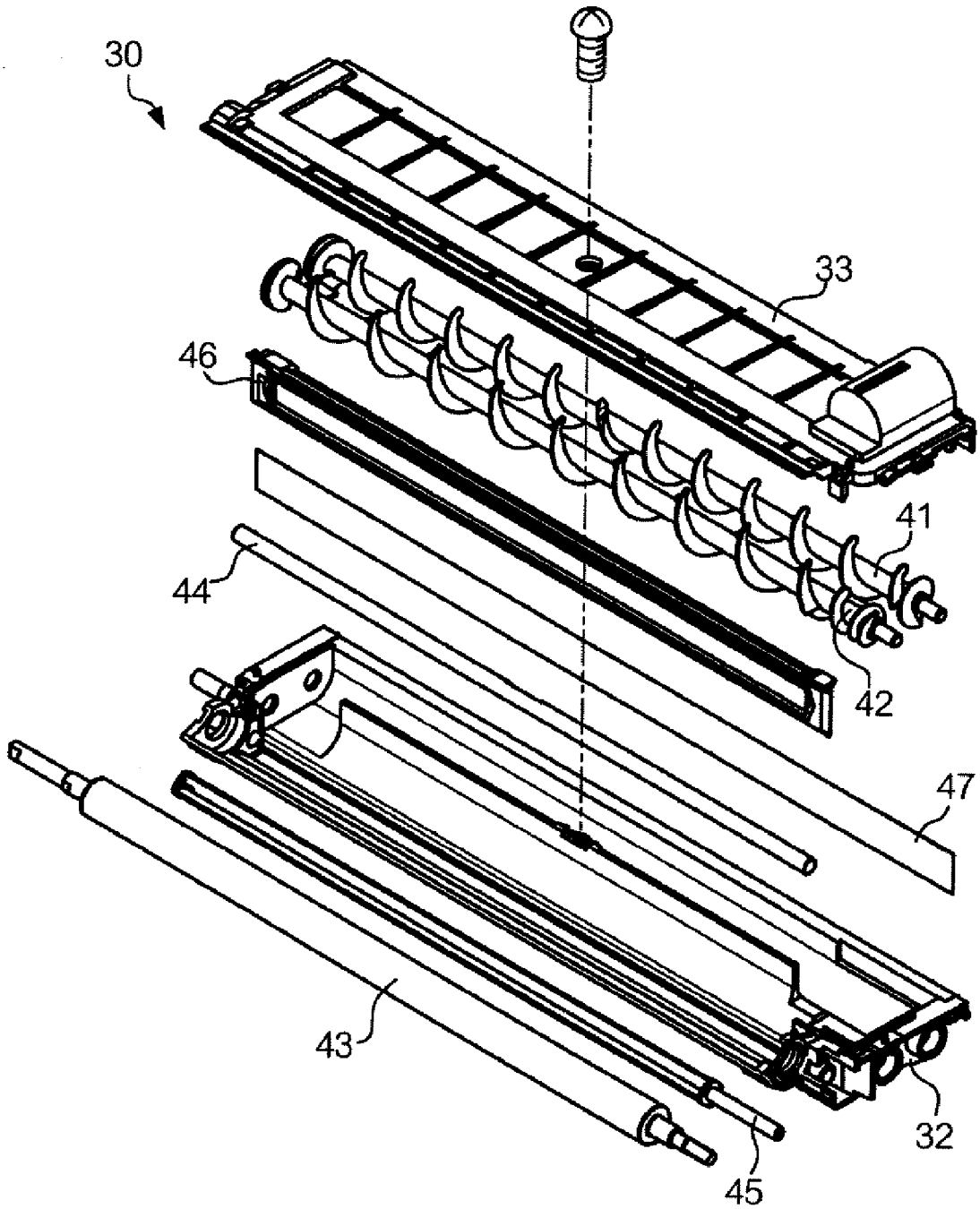
FIG. 3 is an exploded perspective view showing principal components of a developing apparatus according to an exemplary embodiment.
Figure 4:
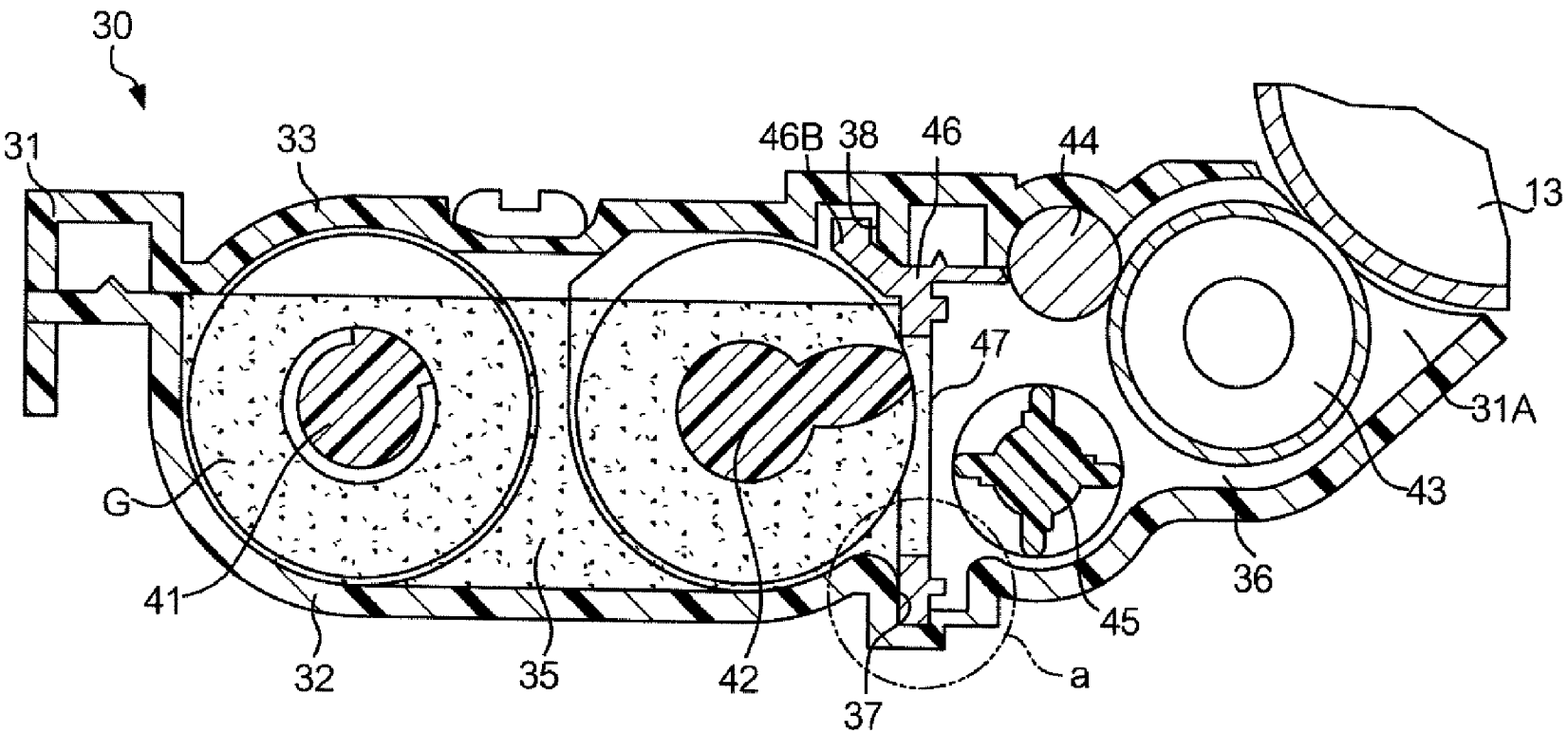
FIG. 4 is a partial cross-sectional view as seen from a direction of arrows IV and IV shown in FIG. 2.

FIG. 2 to FIG. 4 are diagrams showing the developing apparatus 30 according to the present exemplary embodiment. FIG. 2 is a perspective view of the developing apparatus 30, FIG. 3 is an exploded perspective view of principal components, and FIG. 4 is a cross-sectional view as seen from a direction of arrows IV and IV shown in FIG. 2.

The developing apparatus 30 is equipped with a casing 31 having chambers divided into a developer accommodating unit 35 and a developing unit 36, and an opening 31A, an agitating auger 41 and a supply auger 42 arranged in the developer accommodating unit 35, and a trimmer member 44, and a paddle 45 arranged in the developing unit 36.

A portion of the magnet roller 43 is arranged near the photosensitive drum 13 so as to be exposed from the opening 31A of the casing 31. The trimmer member 44 regulates the amount of developer held on the surface of the magnet roller 43. The paddle 45 returns the developer released from the magnet roller 43 after developing is completed to the supply auger 42 side. Rotation from a same drive source is transmitted via gears to the agitating auger 41, the supply auger 42, the magnet roller 43, and the paddle 45 such that each part is rotationally driven.

The casing 31 is constituted by a lower side housing 32, an upper side housing 33, and side covers 34 on the left and right. The inside of the casing 31 in which these parts 32 to 34 are assembled is divided into the developer accommodating unit 35 and the developing unit 36. A developer G is filled inside the developer accommodating unit 35.

In the casing 31, grooves are formed at sites that constitute a boundary between the developer accommodating unit 35 and the developing unit 36 as shown in FIG. 4. These grooves are constituted by a lower groove 37 formed in lower side housing 32 and an upper groove 38 formed in the upper side housing 33, while grooves formed in the side covers 34 are omitted from the diagrams. When the cartridge is unused, a partitioning frame 46 onto which a peel-off seal 47 has been stuck is inserted into the grooves.

It should be noted that the inside of the casing 31 is divided into the developer accommodating unit 35 and the developing unit 36 by this partitioning frame 46.

Figure 6:
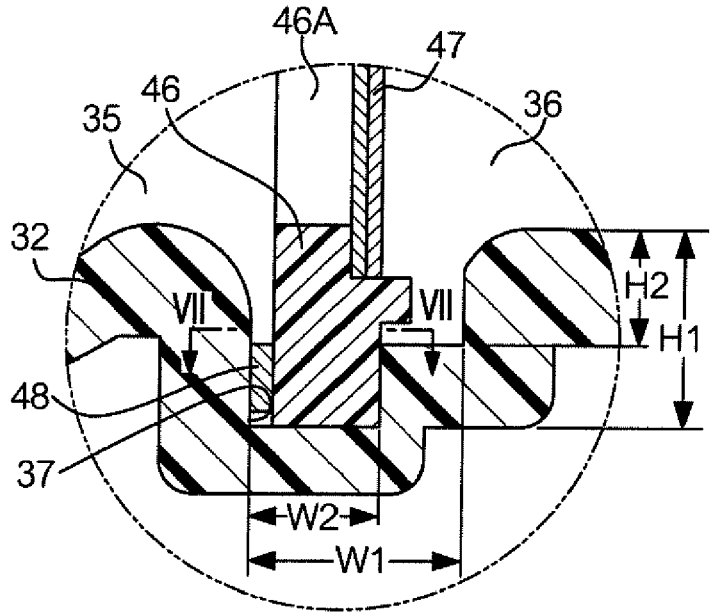
FIG. 6 is a cross-sectional view showing an enlargement of an "a" portion of FIG. 4.

As shown in FIG. 6, the shape of the lower groove 37 involves a groove width whose entrance is W1 and whose interior is W2, with a groove depth whose deep portion is H1 and whose shallow portion is H2, thus forming a stepped groove. Specifically, W1 is 3.5 mm, W2 is 1.5 mm, H1 is 4 mm, and H2 is 3.5 mm.

Figure 5:
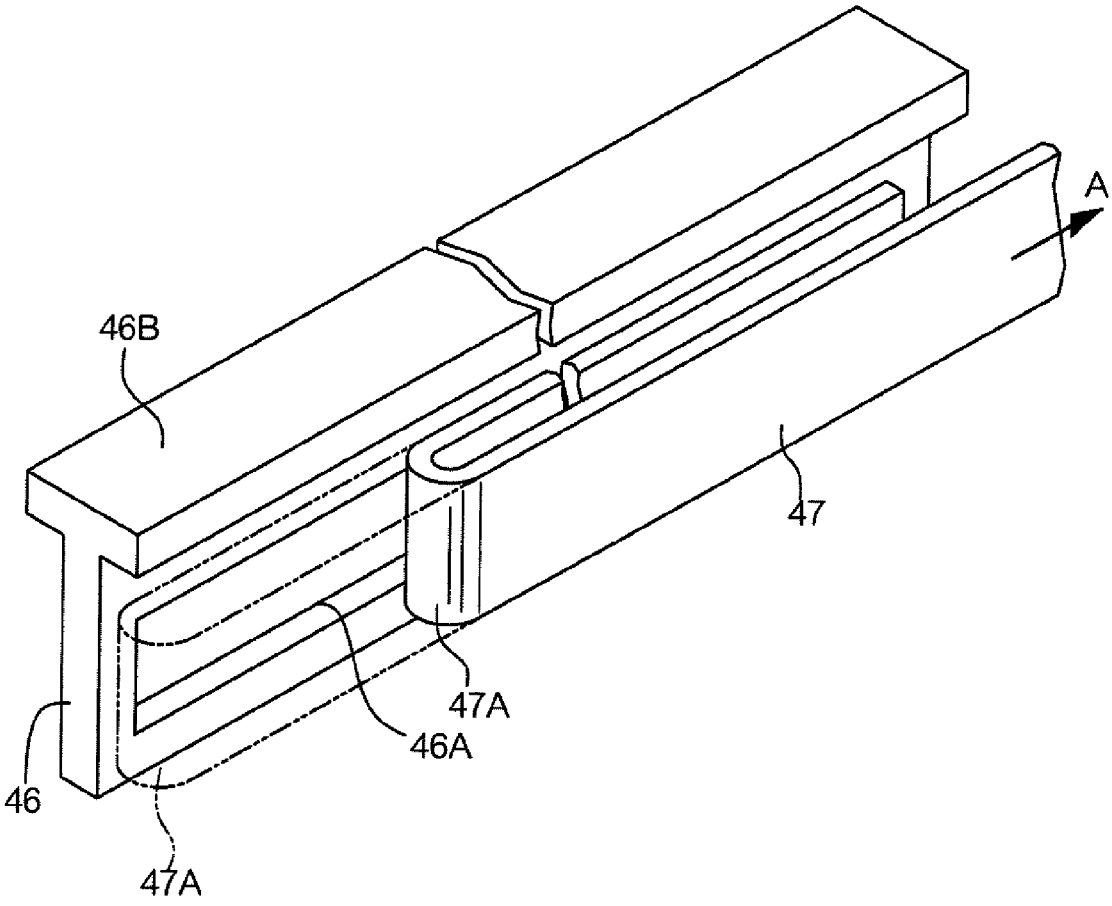
FIG. 5 is a perspective view showing a partitioning frame and a peel-off seal.

Description is given based on FIG. 5 regarding the partitioning frame 46 and the peel-off seal 47.

The partitioning frame 46 has a connecting hole 46A, and a flange unit 46B (see FIG. 4) is formed on one of its long sides. Furthermore, the thickness of the part of the partitioning frame 46 that fits into the lower groove 37 is formed having a thickness substantially equivalent to the groove width W2. The casing 31 and the partitioning frame 46 are formed using an ABS resin (engineering plastic) for example.

An outer circumferential surface of the peel-off seal 47 is stuck to a surface of one side of the partitioning frame 46 using an adhesive so as to block the connecting hole 46A. The length of the peel-off seal 47 is two times or more longer than the partitioning frame 46 so as to be stuck there traversing a lengthwise direction of the partitioning frame 46 twice. With the peel-off seal 47, a front side in FIG. 5 is a turn-back unit 47A, and from a starting point until the turn-back unit 47A is a first half that is adhered to the partitioning frame 46, and from the turn-back unit 47A until its free end is a second half, and this free end extends to the outside via a seal passing path (not shown in drawings) of the side cover 34.

When peeling off the peel-off seal 47 from the partitioning frame 46, the first half of the peel-off seal 47 is peeled off in order from its forward side from the partitioning frame 46 by pulling the free end that extends outside from the side cover in a direction of arrow A such that the turn-back unit 47A moves successively rearward, and by peeling off the first half from the partitioning frame 46, the peel-off seal 47 is completely peeled off such that the connecting hole 46A is communicatively opened.

Features of Exemplary Embodiment

Figure 7:
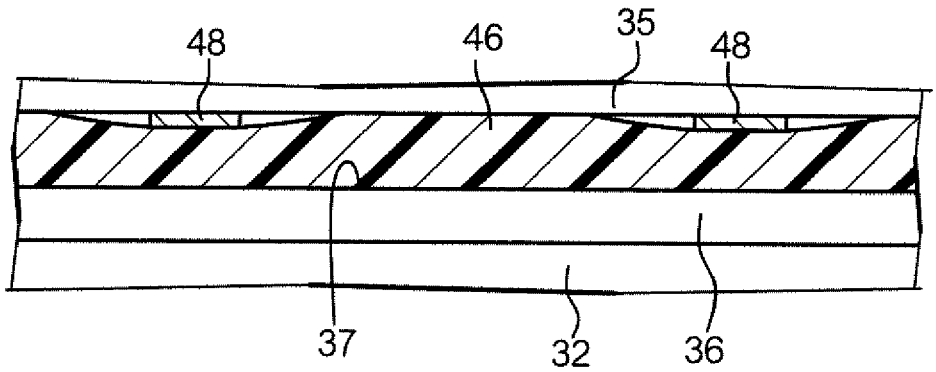
FIG. 7 is a partial cross-sectional view as seen from a direction of arrows VII and VII shown in FIG. 6.

As shown in FIG. 6 and FIG. 7, a feature of the developing apparatus 30 according to the present exemplary embodiment is that an elastic body 48 is provided having an adhesion layer (not shown in drawings) on one or both sides positioned on an other side surface of the partitioning frame 46 from the part of the partitioning frame 46 that is inserted into the lower groove 37. For example, the elastic body 48 may be formed as a plate body using Real Sealer SP for toner seals (polyurethane foam made by Bridgestone Corporation) as a material.

As shown in FIG. 7, the elastic body 48 is provided in multiple locations at predetermined intervals, and while the partitioning frame 46 is inserted into the lower groove 37, adhesion is improved between one side surface of the partitioning frame 46 and the lower groove 37 since a pushing force is applied to the partitioning frame 46 from the elastic body 48.

Test Results

Results of testing are shown in which leakage of developer is measured for a developing apparatus 30 in which the elastic body 48 is provided in the lower groove 37 and a developing apparatus 30' in which the elastic body 48 is not provided.

Focusing on the developer that leaks when a developing apparatus in a storage state is used, the inventors carried out testing in which amounts of the developer G adhering to the magnet roller 43 are measured after predetermined vibration is applied to the developing apparatus 30 in certain positions.

First, a position in which leakages could be considered to occur often is surmised as a case where the magnet roller 43 faced downward in a gravity direction, and in this position a test 1 is carried out in which three developing apparatuses 30' are subjected for 20 minutes to random vibrations of frequencies from 5 Hz to 100 Hz and an amplitude of 3 cm, and as a result no remarkable leakage of developer is detected.

Converse to this, a test 2 is carried out in which vibrations are applied under the aforementioned conditions in a case where the magnet roller 43 faced upward in the gravity direction, and as a result, leakages as shown in Table 1 are detected.

TABLE 1

| Developing apparatus no. | Adhesion amount (g) |
|---|---|
| 1 | 0.1 |
| 2 | 0.5 |
| 3 | 0.7 |

Further still, a test 3 is carried out in which vibrations are applied under the aforementioned conditions while the magnet roller 43 faced downward in the gravity direction after vibrations are applied under the aforementioned conditions while the magnet roller 43 faced upward in the gravity direction, and as a result, leakages as shown in Table 2 are detected.

TABLE 2

| Developing apparatus no. | Adhesion amount (g) |
|---|---|
| 1 | 2.42 |
| 2 | 1.50 |
| 3 | 2.00 |

From these results, the following considerations are made.

Namely, it is considered that since gravity of the developer G inside the developer accommodating unit 35 is applied to the partitioning frame 46 while the magnet roller 43 faced downward in the gravity direction in test 1, the partitioning frame 46 adhered to the groove with no leeway and as a result there is no leakage in this state.

On the other hand, since the gravity of the developer G did not act on the partitioning frame 46 such that there is leeway between the groove and the partitioning frame 46 while the magnet roller 43 faced upward in the gravity direction in test 2, the developer G that swirled up inside the developer accommodating unit 35 escaped between the vibrating partitioning frame 46 and the groove, and it is considered that once the developer had escaped once a passageway is formed such that the developer G leaked out.

Further still, in the case of test 3 where vibration is applied while the magnet roller 43 faced upward in the gravity direction after which vibration is applied while the magnet roller 43 faced downward in the gravity direction, it is considered that the developer G leaked through the already formed passageway.

Next, results of carrying out testing identical to tests 2 and 3 are shown for the developing apparatus 30 according to the present exemplary embodiment.

TABLE 3

| Developing apparatus no. | Adhesion amount (g) |
|---|---|
| 1 | 0.02 |
| 2 | ≦0.0* |
| 3 | 0.04 |

*Leakage is beyond a limit of measurement, but visually confirmed.

TABLE 4

| Developing apparatus no. | Adhesion amount (g) |
|---|---|
| 1 | 0.05 |
| 2 | 0.03 |
| 3 | 0.03 |

As is clear from comparing the test results in tables 1 and 2 and tables 3 and 4, it is evident that occurrences of leakages of the developer G from the developer accommodating unit 35 are remarkably improved by providing the elastic body 48.

Effects of Exemplary Embodiment

As described above, with the developing apparatus 30 according to the present exemplary embodiment, by providing the elastic body 48 having an adhesion layer (not shown in drawings) on one or both sides positioned on the other side surface of the partitioning frame 46 from the part of the partitioning frame 46 that is inserted into the lower groove 37, the amount of developer G that leaks out from the developer accommodating unit 35 to the developing unit 36 side can be almost eliminated as is evident from the test results. As a result, in an operation of peeling off the peel-off seal 47 from the partitioning frame 46 when replacing the developing apparatus 30, a user or service personnel and a surrounding area thereof can be reliably prevented from being smeared by developer.

Furthermore, of the front and back surfaces of the partitioning frame 46, since the elastic body 48 is provided so as to be positioned on a surface side of the partitioning frame 46 where the peel-off seal 47 does not stick, the peel-off seal 47 is prevented from contacting or sandwiching the elastic body 48 and becoming an obstacle to the peel-off operation of the peel-off seal 47 when pealing off the peel-off seal 47 from the partitioning frame 46, and therefore the peel-off seal 47 can be reliably prevented from becoming severed.

Further still, to improve the adhesion between the partitioning frame 46 and the lower groove 37, an entire circumference thereof may be secured using an adhesive, but in this case costs are increased and the casing 31 cannot be reused. In contrast to this, with the developing apparatus 30 according to the present exemplary embodiment, the adhesion between the partitioning frame 46 and the lower groove 37 is improved by the elastic body 48, such that cost reductions can be achieved and reuse of the casing 31 can also be achieved.

MODIFIED EXAMPLE 1

Figure 8:
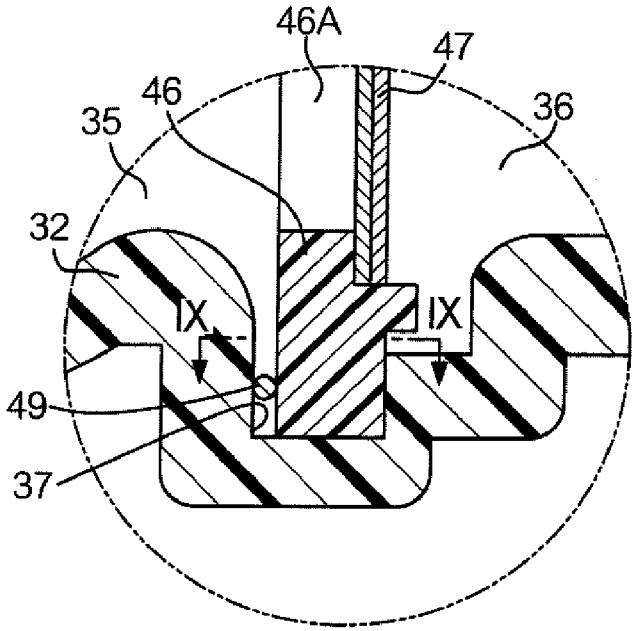
FIG. 8 is a cross-sectional view from a same position as FIG. 6 according to a modified example.
Figure 9:
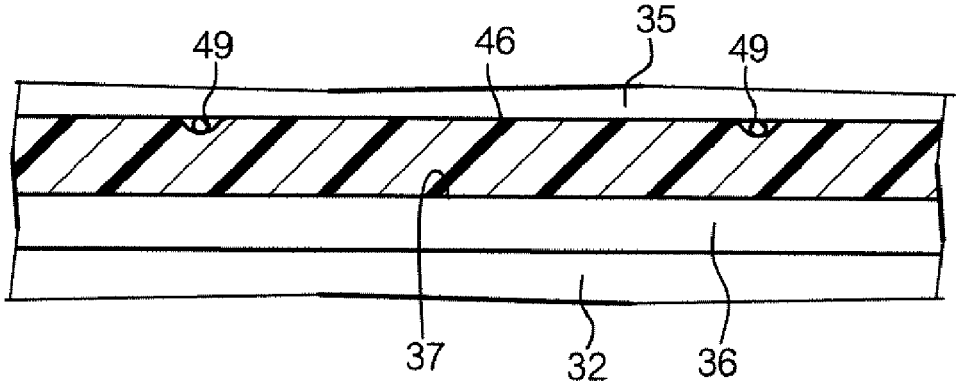
FIG. 9 is a partial cross-sectional view as seen from a direction of arrows IX and IX shown in FIG. 8.

In the foregoing exemplary embodiment, description is given regarding a case where the elastic body 48 is provided to a closely contact section, but the present invention is not limited to this and this may be a protrusion 49 as shown in FIG. 8 and FIG. 9. The protrusion 49 may be formed at the lower side housing 32 where the lower groove 37 is formed, or may be formed at the partitioning frame 46, or may be formed at both of these members.

Furthermore, instead of the elastic body 48, an adhesive may also be applied. In this case, it is necessary to determine the amount to be applied taking care so that it does not stick out from the lower groove 37. Further still, the closely contact section may be a member that increases adhesion of the partitioning frame 46 to the lower groove 37 such as double-sided tape or a sponge and the like.

MODIFIED EXAMPLE 2

Further still, in the foregoing embodiment and modified example 1, multiple instances of the elastic body 48, the protrusions 49, and the adhesive are provided with the closely contact section at predetermined intervals on the lower groove 37, but the present invention is not limited to this, and the closely contact section may be configured as a sheet-shaped member extending across the lower groove 37 lengthwise.

MODIFIED EXAMPLE 3

In the foregoing exemplary embodiment and modified examples 1 and 2, the closely contact section is provided between the lower groove 37 of the lower side housing 32 and the partitioning frame 46, but naturally a closely contact section may also be provided in a groove of the upper side housing 33 or the side covers 34.

MODIFIED EXAMPLE 4

In the foregoing exemplary embodiment, the peel-off seal 47 is used as a partition that blocked the connecting hole 46A of the partitioning frame 46, but the present invention is not limited to this, and a slidable partitioning panel may be used in the partitioning frame 46 as the partition.

Furthermore, the closely contact section is provided positioned on a surface side of the front and back sides of the partitioning frame 46 where the peel-off seal 47 is not adhered, but this may be provided positioned on a surface of the front and back sides of the partitioning frame 46 where the peel-off seal 47 is adhered.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing apparatus, comprising:

a housing comprising:

an opening that opens towards an image carrier on which an electrostatic latent image is formed; and a developer storing unit in which a developer is stored;

a developer carrier configured to:

carry the developer stored in the developer storing unit; and transport the developer to a developing region in opposition to the image carrier;

a partitioning frame arranged in a groove formed between the developer carrier and the developer storing unit of the housing, that is provided with a connecting hole which enables connect between the developer storing unit and the opening;

a partition arranged on a side surface of the partitioning frame; and a closely contact section that causes the partitioning frame to closely contact to the groove, wherein the closely contact section is arranged between the groove and a side surface of the partitioning frame not provided with the partition, wherein the closely contact section includes an elastic member sandwiched between the partitioning frame and the groove, and wherein a plurality of the closely contact sections are provided at intervals.

2. The developing apparatus according to claim 1, wherein the partition is capable of being peeled off from the partitioning frame.

3. The developing apparatus according to claim 2, wherein peeling off of the partition causes the connecting hole to open to enable the developer accommodated in the developer accommodating unit to move toward the opening.

4. The developing apparatus according to claim 1, wherein the partition comprises a sheet member that adheres to the partitioning frame.

5. A process cartridge, comprising:

an image carrier on which an electrostatic latent image is formed on a surface; and a developing apparatus configured to use a developer to make visible the electrostatic latent image formed on the image carrier, the developing apparatus comprising:

a housing comprising:

an opening that opens towards an image carrier on which an electrostatic latent image is formed; and a developer storing unit in which a developer is stored;

a developer carrier configured to:

carries carry the developer stored in the developer storing unit; and transport the developer to a developing region in opposition to the image carrier;

a partitioning frame arranged in a groove formed between the developer carrier and the developer storing unit of the housing, that is provided with a connecting hole which enables connect between the developer storing unit and the opening;

a partition arranged on a side surface of the partitioning frame; and a closely contact section that causes the partitioning frame to closely contact to the groove, wherein the closely contact section is arranged between the groove and a side surface of the partitioning frame not provided with the partition, wherein the closely contact section includes an elastic member sandwiched between the partitioning frame and the groove, and wherein a plurality of the closely contact sections are provided at intervals.

6. The process cartridge according to claim 5, wherein the partition is capable of being peeled off from the partitioning frame.

7. The process cartridge according to claim 6, wherein peeling off of the partition causes the connecting hole to open to enable the developer accommodated in the developer accommodating unit to move toward the opening.

8. The process cartridge according to claim 5, wherein the partition comprises a sheet member that adheres to the partitioning frame.

9. An image forming apparatus, comprising:

a developing apparatus;

a latent image forming unit configured to form an electrostatic latent image on an image carrier; and a transfer unit configured to transfer a toner image obtained using the developing apparatus to make the electrostatic latent image visible, to a recording medium, the developing apparatus containing:

a housing comprising:

an opening that opens towards an image carrier on which an electrostatic latent image is formed; and a developer storing unit in which a developer is stored;

a developer carrier configured to:

carry the developer stored in the developer storing unit; and transport the developer to a developing region in opposition to the image carrier;

a partitioning frame arranged in a groove formed between the developer carrier and the developer storing unit of the housing, that is provided with a connecting hole which enables connect between the developer storing unit and the opening;

a partition arranged on a side surface of the partitioning frame; and a closely contact section that causes the partitioning frame to closely contact to the groove, wherein the closely contact section is arranged between the groove and a side surface of the partitioning frame not provided with the partition, wherein the closely contact section includes an elastic member sandwiched between the partitioning frame and the groove, and wherein a plurality of the closely contact sections are provided at intervals.

10. The image forming apparatus according to claim 9, wherein the partition is capable of being peeled off from the partitioning frame.

11. The image forming apparatus according to claim 10, wherein peeling off of the partition causes the connecting hole to open to enable the developer accommodated in the developer accommodating unit to move toward the opening.

12. The image forming apparatus according to claim 9, wherein the partition comprises a sheet member that adheres to the partitioning frame.

* * * * *